US009776336B2

(12) United States Patent
Koch

(10) Patent No.: US 9,776,336 B2
(45) Date of Patent: Oct. 3, 2017

(54) SLICING MACHINE FOR FOOD PRODUCTS

(75) Inventor: Nikolaus Koch, Geislingen (DE)

(73) Assignee: BIZERBA SE & CO. KG, Balingen (DE)

( * ) Notice: Subject to any disclaimer, the term of this patent is extended or adjusted under 35 U.S.C. 154(b) by 994 days.

(21) Appl. No.: 13/508,566

(22) PCT Filed: Oct. 26, 2010

(86) PCT No.: PCT/EP2010/006515

§ 371 (c)(1),
(2), (4) Date: May 8, 2012

(87) PCT Pub. No.: WO2011/057713

PCT Pub. Date: May 19, 2011

(65) Prior Publication Data

US 2012/0222533 A1 Sep. 6, 2012

(30) Foreign Application Priority Data

Nov. 13, 2009 (DE) ..... 10 2009 052 866

(51) Int. Cl.

| | |
|---|---|
| ***B26D 7/22*** | (2006.01) |
| *B26D 1/143* | (2006.01) |
| *B26D 7/00* | (2006.01) |
| *B26D 7/06* | (2006.01) |

(52) U.S. Cl.

CPC ..... *B26D 7/22* (2013.01); *B26D 7/225* (2013.01); *B26D 1/143* (2013.01); *B26D 7/00* (2013.01); *B26D 7/0616* (2013.01); *B26D 2210/02* (2013.01); *Y10S 83/932* (2013.01); *Y10T 83/6608* (2015.04)

(58) Field of Classification Search

CPC ..... B26D 7/225; B26D 1/143; B26D 7/0616; B26D 2210/02; Y10T 83/6608

USPC ..... 83/932, 707, 717, 729, 730

See application file for complete search history.

(56) References Cited

U.S. PATENT DOCUMENTS

| | | | | |
|---|---|---|---|---|
| 1,978,929 A * | 10/1934 | Breaden | B26D 1/143 83/174.1 |
| 2,004,601 A * | 6/1935 | Folk | B26D 1/143 83/421 |
| 2,043,850 A * | 6/1936 | Folk | B26D 1/143 83/713 |

(Continued)

FOREIGN PATENT DOCUMENTS

DE 3013469 A1 11/1981

OTHER PUBLICATIONS

European Patent Office, International Search Report in International Patent Application No. PCT/EP2010/006515 (Feb. 22, 2011).

*Primary Examiner* — Stephen Choi
*Assistant Examiner* — Evan MacFarlane
(74) *Attorney, Agent, or Firm* — Leydig, Voit & Mayer, Ltd.

(57) ABSTRACT

A cutting machine for cutting a food product includes a housing and a blade cover removably mounted to the housing via at least two positive or non-positive fastening points. A circular blade is rotatably disposed in the housing such that the blade cover covers a surface of the circular blade. A carriage is movably mounted parallel to the circular blade and includes a carriage surface for holding the food product. Each of the fastening points are disposed beneath the carriage surface.

15 Claims, 4 Drawing Sheets

(56) References Cited

U.S. PATENT DOCUMENTS

| | | | | | |
|---|---|---|---|---|---|
| 2,065,572 | A * | 12/1936 | Folk | B26D 7/22 | 83/546 |
| 2,728,367 | A * | 12/1955 | Brown | B26D 7/22 | 83/421 |
| 2,746,500 | A * | 5/1956 | Klingens | B26D 1/153 | 241/199.6 |
| 5,188,011 | A * | 2/1993 | Somal | B26D 7/22 | 83/478 |
| 2009/0064876 | A1* | 3/2009 | Feizi | B26D 7/00 | 99/537 |
| 2009/0071310 | A1* | 3/2009 | Rummel | B26D 7/22 | 83/707 |

* cited by examiner (A - A)

(B - B)

SLICING MACHINE FOR FOOD PRODUCTS

CROSS-REFERENCE TO PRIOR APPLICATIONS

This application is a U.S. National Phase application under 35 U.S.C. §371 of International Application No. PCT/EP2010/006515, filed on Oct. 26, 2010, and claims benefit to German Patent Application No. DE 10 2009 052 866.0, filed on Nov. 13, 2009. The International Application was published in German on May 19, 2011 as WO 2011/057713 under PCT Article 21(2).

FIELD

The invention relates to a cutting machine for food products.

BACKGROUND

Such cutting machines are used in actual practice to cut slices of elongated food products. For safety reasons, the cutting blade has to be covered to such an extent that the risk of injury is reduced. For cleaning purposes, it is desirable for the covering device to be removable.

German patent application DE 30 13 469 A1 describes such a cutting machine with a removable blade cover. The blade cover is connected by means of fastening points to a blade protection ring and it can be removed after a lock is released.

When food having a large diameter is being cut, the problem arises that the food passes over the fastening points. On the one hand, this entails a great deal of soiling and, on the other hand, it yields a dirty contact surface and consequently poor cutting results with the cutting machine.

SUMMARY

In an embodiment, the present invention provides a cutting machine for cutting a food product. The cutting machine includes a housing and a blade cover removably mounted to the housing via at least two positive or non-positive fastening points. A circular blade is rotatably disposed in the housing such that the blade cover covers a surface of the circular blade. A carriage is movably mounted parallel to the circular blade and includes a carriage surface for holding the food product. Each of the fastening points are disposed beneath the carriage surface.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
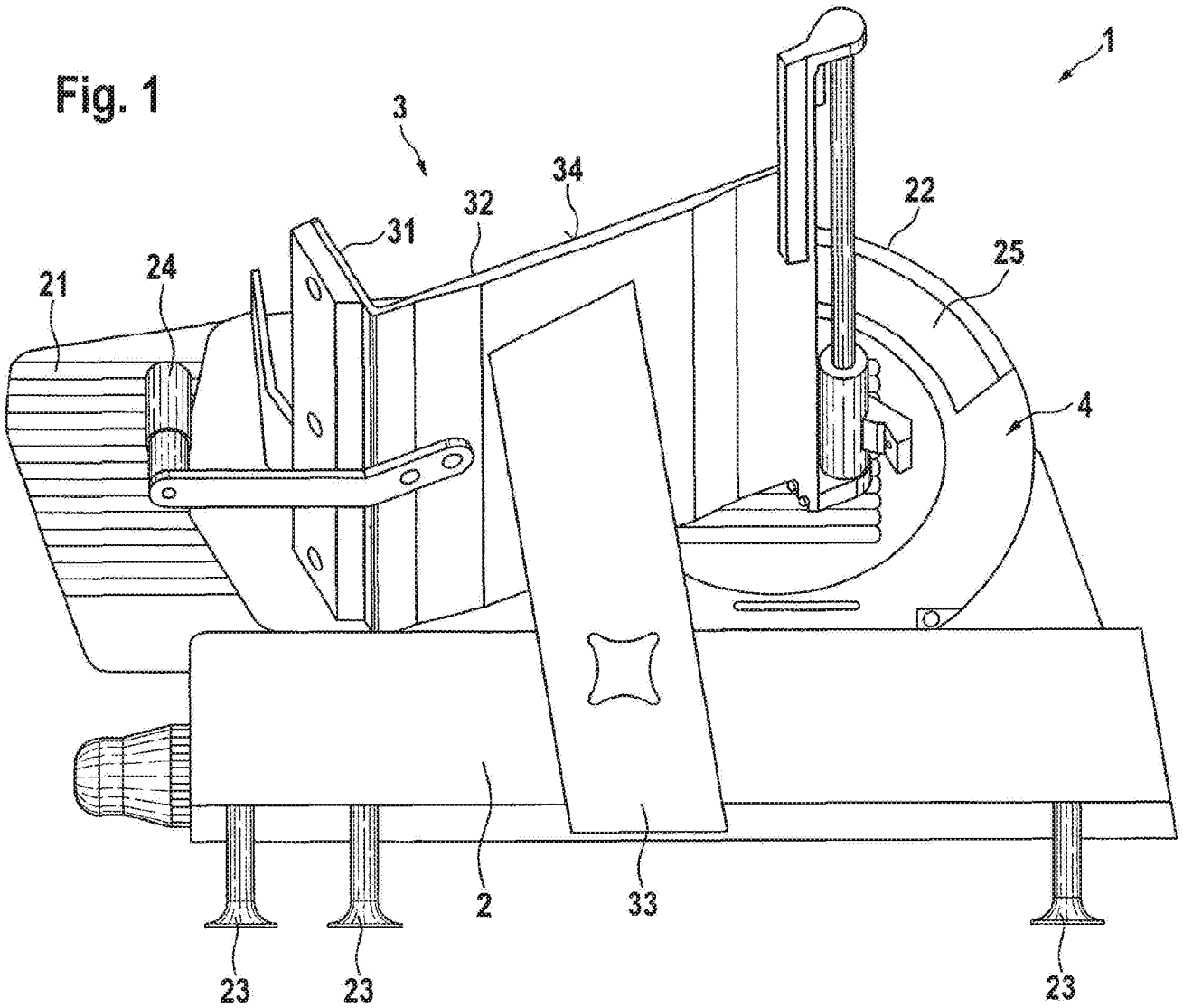
FIG. 1 a schematic view of the cutting machine from the side.

In an embodiment, the present invention provides a cutting machine that, even with food having large diameters, yields good cutting results and ensures a high standard of hygiene.

All of the positive or non-positive fastening points of the removable blade cover are arranged beneath the carriage surface. The food to be cut is placed onto a food placement surface of the carriage and, in order to be cut, it is moved together with the carriage parallel to the circular blade. In this process, the food to be cut is in direct contact with the blade cover over a considerable distance. If the surface of the blade cover has irregularities in the form of fastening points, they hinder the movement of the food and thus have a negative impact on the cutting results. Therefore, in the cutting machines known from the state of the art, only food having a small diameter can be used in order to ensure that the contact surface of the food to be cut is not affected by irregularities. The arrangement of all of the positive or non-positive fastening points beneath the carriage surface and thus beneath the placement surface or contact surface for the food to be cut and beneath the blade cover now ensures that this contact surface is free of irregularities, regardless of how large the diameter of the food to be cut is.

In order to achieve a mechanically stable mounting of the blade cover, one embodiment provides that the carriage surface is slanted with respect to the horizontal and especially, it has a V-shaped configuration. All of the positive or non-positive fastening points of the blade cover are arranged beneath one leg of the V-shaped carriage surface. As a result, it is possible to arrange the fastening points in a triangle and thus to achieve a mechanically stable mounting. In contrast to this proposed solution, the familiar state of the art explicitly prescribes the requisite mechanically stable mounting by stating that the fastening points have to be arranged distributed over the circumference of the blade cover and consequently, they are unavoidably situated within the contact surface of food having a large diameter.

One structurally advantageous embodiment provides that the fastening points of the blade cover are in the form of positive and/or non-positive connection elements that detachably connect the blade cover to the housing of the cutting machine and/or to a blade protection ring fastened to the housing. Such connections can be configured, for example, as bolts, screws, clamped closures or bars.

A mechanically stable embodiment of the blade cover, along with the most complete possible covering of the cutting blade, is achieved in that the blade cover, especially the outer contour of the blade cover, is essentially circular and has two areas that each have different diameters. In the area below the carriage support, that is to say, in the area of the fastening points or of the holding area, the blade cover has a diameter that essentially matches the diameter of the blade protection ring. In the area above the carriage support, i.e. in the cover area, the blade cover has a diameter that is smaller than the diameter of the cutting blade. The midpoints of the two diameters of the outer contour are very close to each other in the area of the pivot point of the circular blade.

It is provided that, in the area above the carriage, that is to say, in the cover area, the circular blade or cutting blade has a negative curvature, that is to say, it has a concave configuration, whereas, in the cover area, the blade cover has a positive curvature, that is to say, it has a convex configuration, so that the cover area engages into a structural space formed by the negative curvature of the circular blade. As a result, even when the wall of the blade cover for the food to be cut is very thick, the blade cover and the cutting blade form a shared surface that has an essentially smooth contour on which the food to be cut can slide without hindrance.

One embodiment provides that the cutting machine according to the invention is configured as a slanted cutter. This means that the cutting plane in which the circular blade rotates is slanted with respect to the vertical. Another embodiment can provide that the cutting machine according to the invention is configured as a vertical cutter. This means that the cutting plane in which the circular blade rotates is arranged vertically.

One use of the cutting machine is in the food industry or in the retail trade for slicing food products such as, for example, cold cuts, meat, fish, cheese or vegetables.

FIG. 1 shows a cutting machine 1 for cutting cold cuts or cheese slices. The cutting machine 1 has a housing 2 in which a linearly movable carriage 3 is mounted on a carriage foot 33. By means of a grip 24, the carriage can be moved back and forth manually, that is to say, parallel to the cutting plane defined by the cutting blade 25. In order to allow up the cutting machine to be placed on a substrate, the housing 2 has housing feet 23. Moreover, the housing has a stop plate 21 as a stop to set the thickness of the food slices that are to be cut. The carriage 3 has a carriage surface 34 that serves as a contact surface for the food to be cut. It has a V-shaped configuration and has a first leg 31 and a second leg 32. Food products can be placed into this V-shaped trough and can be cut into slices by moving the carriage 3 of the cutting machine 1 back and forth.

Inside the housing 2, there is a motor that rotated the circular blade 25. The stop plate 21 runs parallel to the circular blade 25 and forms a stop for the food that has been placed onto the carriage. An adjustment device with an adjustment knob arranged on the outside of the housing can be used to adjust the distance between the stop plate and the circular blade 25, and thus to adjust the cutting slit or the slice thickness of the food that is to be sliced.

On the circumference of the circular blade 25, there is a cutting edge that is covered by a blade protection ring 22 that is permanently connected to the housing 2. The blade protection ring 22 encloses the cutting edge in a C-shaped manner and leaves only a small area of the cutting edge free for cutting purposes. The blade protection ring 22 covers the blade in an area of about 200° to 340° and secures a blade cover 4.

Figure 2:
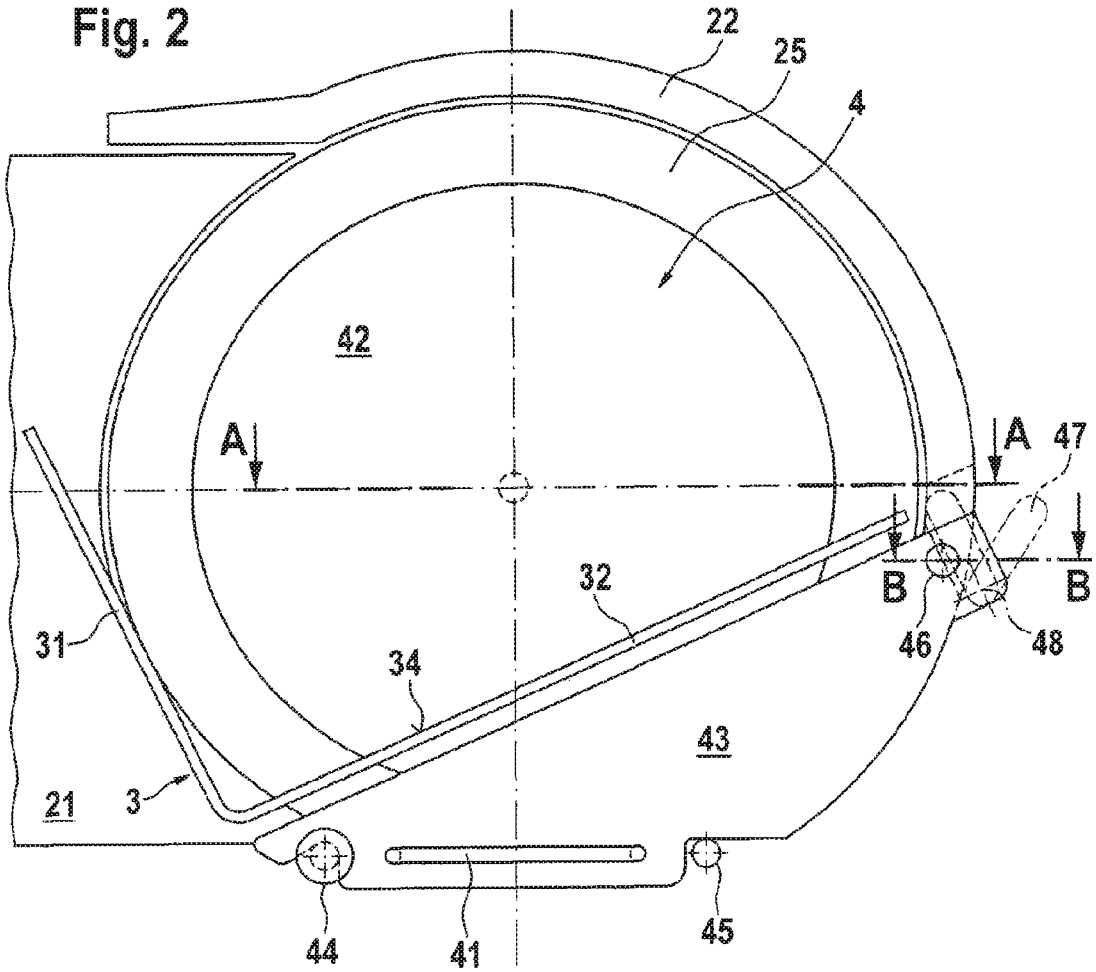
FIG. 2 an enlarged view of the blade cover.
Figure 2A:
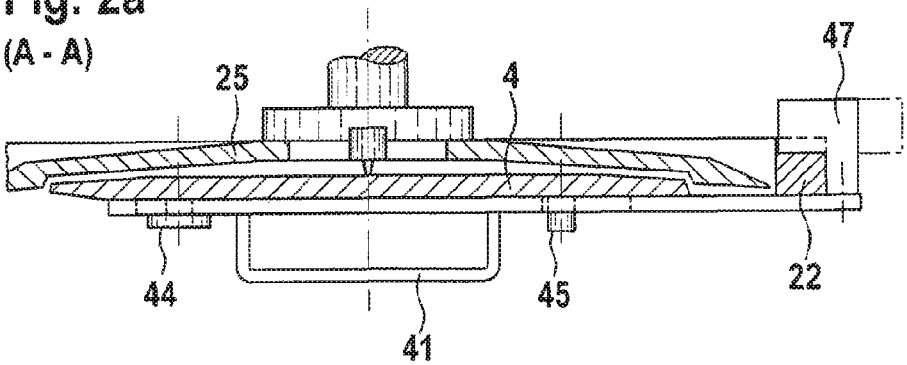
FIG. 2*a* a sectional view along line A-A in FIG. 2.
Figure 2B:
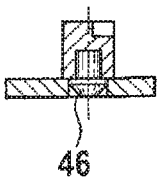
FIG. 2*b* a sectional view along line B-B in FIG. 2.

FIG. 2 shows the blade cover 4. The sectional view of FIG. 2*a* shows a horizontal section along line A-A of FIG. 2. FIG. 2*b* shows a sectional view of line B-B. The blade cover 4 has two areas. A first area is configured as a cover area 42 with a round outer contour. It has a smaller diameter than the cutting blade 25. It runs parallel to the cutting blade and is centered with respect to it, in other words, it is arranged in the center or pivot point of the cutting blade 25. Thus, the first section 42 covers most of the cutting blade 25 and forms an effective protection against accidental touching. At the same time, the blade cover 4 allows enough space in the edge area of the cutting blade 25 to slice the food that is to be cut.

A holding area 43 is shaped as one piece onto the first area 42 in the lower area of the blade cover 4. In the holding area, there are three fastening points 44, 45, 46 that detachably connect the blade cover 4 to the blade protection ring 22 or to the housing 2. A handle 41 is permanently connected to the holding area and facilitates the handling of the blade cover. The holding area 43, like the fastening points 44, 45, 46, are arranged beneath the carriage surface 34. The holding area 43, at least in sections, has an essentially round outer contour that is flush with the contour of the blade protection ring; in particular, its diameter matches the diameter of the blade protection ring 22. The slanted leg 32 of the carriage closes off the lower area towards the top.

In the carriage position shown in FIG. 2, the carriage 3 is in its front end position, that is to say, in its position that is furthest to the right side of FIG. 2. When the carriage 3 travels, it can be moved from there further to the left. The result is that in no position of the carriage 3 is it possible for any of the fastening points 44, 45, 46 to come into contact with the food to be cut and thus become dirty or have a negative impact on the cutting results.

For cleaning purposes, the blade cover 4 can easily be removed and put back into place. When the blade protection cover 4 is fastened to the blade protection ring, while the carriage 3 is retracted, the blade cover 4 is inserted leaving a corresponding gap into the fastening point 44, which is shaped like a mushroom. With an additional gap, the blade cover 4 then already rests on the fastening point 45, which is configured as a holding pin. The third fastening point 46 is configured as a fastening bolt that is arranged in the blade cover 4 and that passes with a precise fit through an opening in the blade cover 4. For purposes of the final fastening, the blade cover 4 is locked by means of a bar 47 that can be pivoted around an axis 48. The connection lines of the three fastening points 44, 45, 46 form a triangle and thus a stable triangular mount for the blade cover 4. The blade cover 4 is removed in the opposite order, starting with the unlocking of the bar 47.

The bar 47 has a slanted ramp so that, when the blade cover 4 is locked, it is pulled against the blade protection ring 22 where it is in close contact and is thus fastened without play. The bar 47 is arranged behind the blade protection ring and consequently, for operating purposes, there is a need to reach around the blade protection ring 22.

Figure 3A:
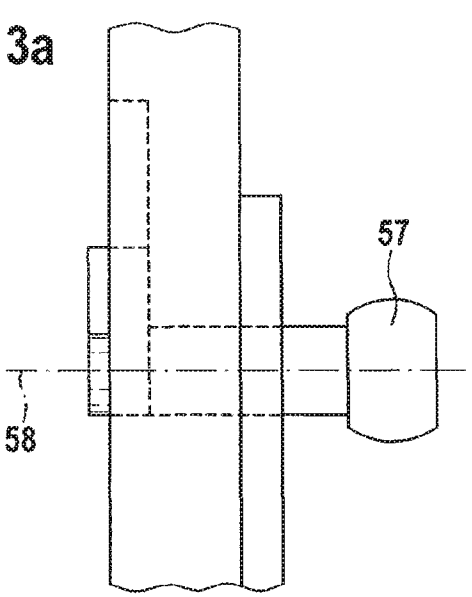
FIGS. 3*a* and 3*b* sectional views of FIG. 3.
Figure 3B:
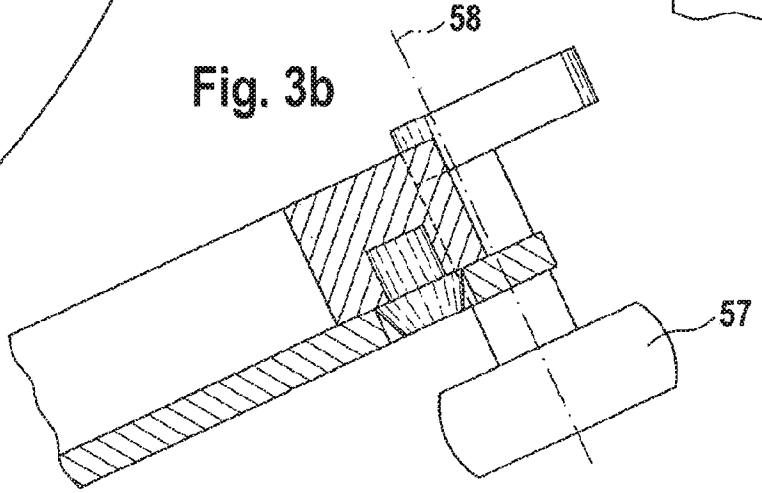
Figure 3:
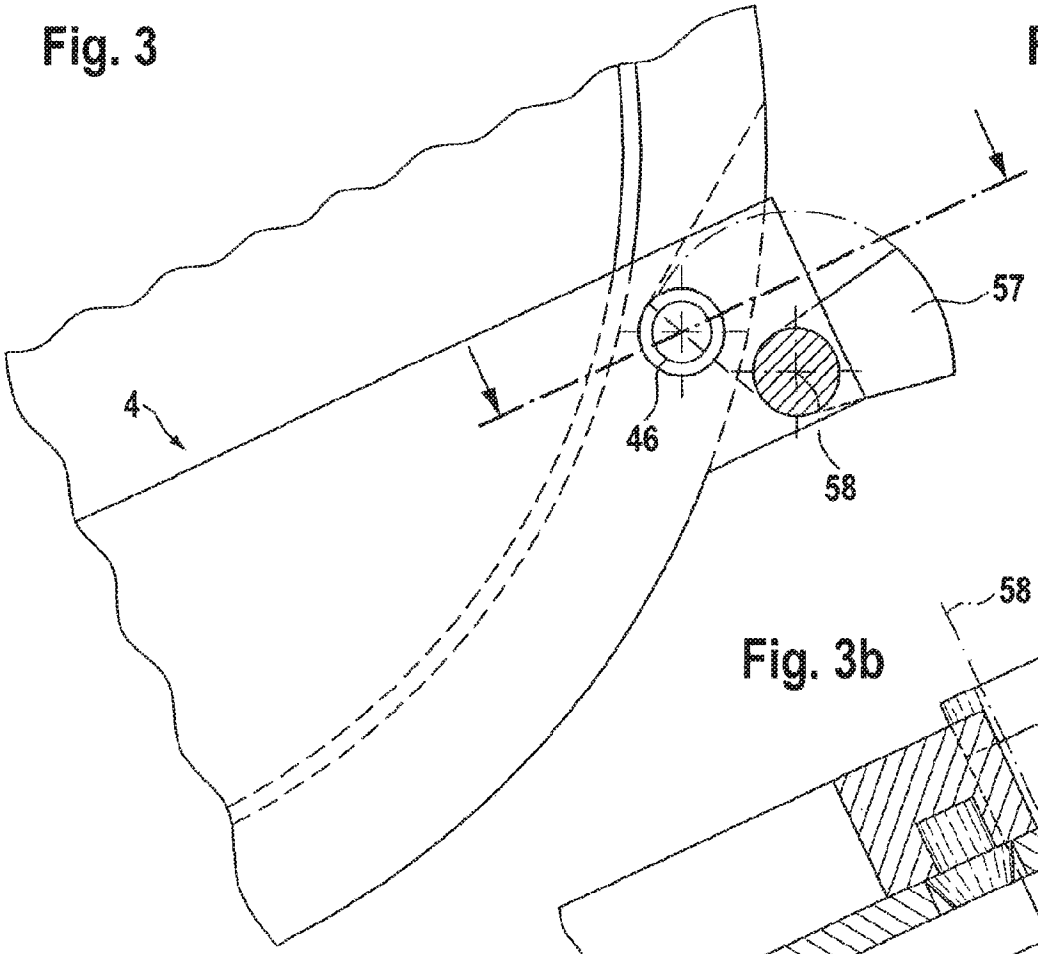
FIG. 3 an enlarged view of a variant of the fastening bar.

FIGS. 3, 3*a* and 3*b* show a variant of the fastening point 46. Unlike the variant shown in FIGS. 2 to 2*b*, the bar needed to lock the blade cover is now operated by a knob 57 that is pivoted around an axis 58 and that is arranged in front of the blade cover 4. With this variant, there is no need to reach around the blade cover.

Figure 4A:
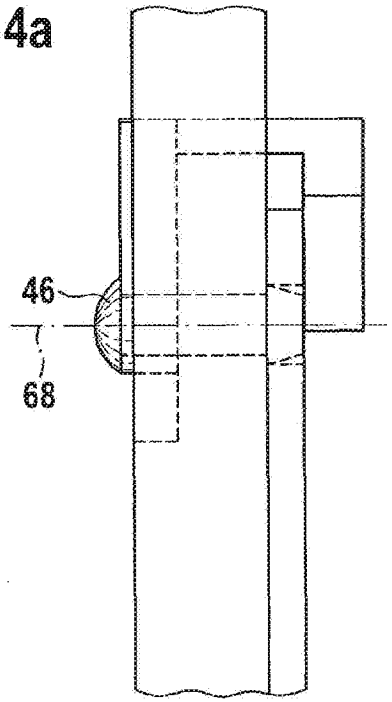
FIGS. 4*a* and 4*b* sectional views of FIG. 4.
Figure 4B:
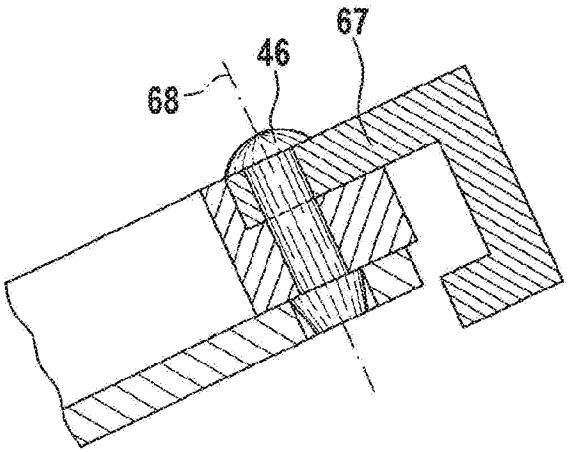
Figure 4:
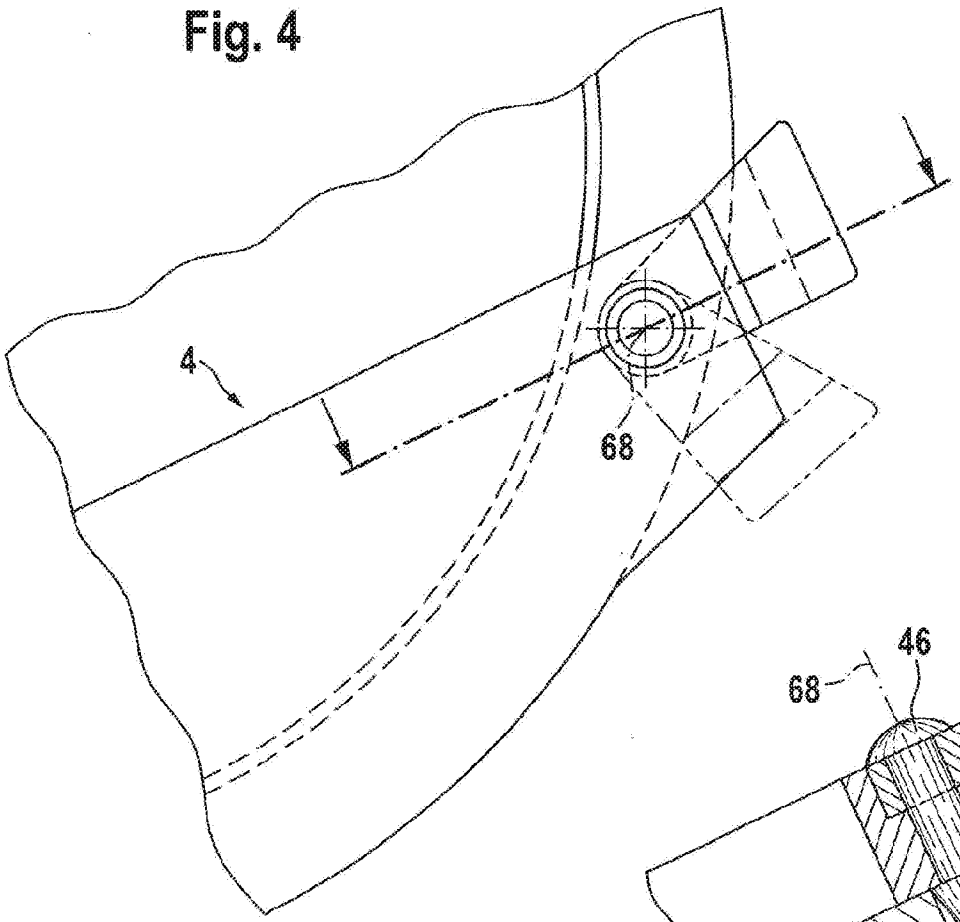
FIG. 4 an enlarged view of another variant of the fastening bar.

FIGS. 4, 4*a* and 4*b* show another variant of the fastening point 46. The pivoting bar 67 is configured here as a U-shaped bar that is mounted on the blade protection ring 22 so as to pivot around an axis 68.

All of the embodiments of the pivoting bar 47, 57, 67 shown have in common that they have a slanted ramp and that they simultaneously tension the blade cover 4 against the blade protection ring 22 during the locking procedure.

By the same token, the blade protection ring 22 can have a slanted ramp which the pivoting bar 47, 57, 67 runs into in order to tension the blade cover.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

The invention claimed is:

1. A cutting machine for cutting a food product, comprising:

a housing;

a blade cover detachably mounted to the housing via at least a first fastening point and a second fastening point;

a circular blade rotatably disposed in the housing such that the blade cover covers a surface of the circular blade, wherein the housing includes a blade protection ring that encloses a cutting edge of the circular blade in a C-shaped manner, the blade cover being connected to the blade protection ring; and a carriage movably mounted parallel to the circular blade, the carriage including a carriage surface for holding the food product, wherein the first fastening point is shaped like a mushroom, wherein the second fastening point comprises a bolt disposed on the blade protection ring that engages into an opening of the blade cover, wherein the cutting machine further comprises a movable bar that, in a closed position, is configured to interact with the second fastening point to affix the blade cover by pulling the blade cover against the blade protection ring, in the closed position the movable bar being arranged behind the blade protection ring in an area of the second fastening point such that an axis of the bolt of the second fastening point is within a radius defined by a length of the movable bar from an axis of the movable bar about which the movable bar is pivotable between the closed position and an open position, and wherein the first and second fastening points detachably mounting the blade cover to the housing are disposed beneath the carriage surface.

2. The cutting machine according to claim 1, wherein the carriage surface is slanted with respect to a horizontal surface.

3. The cutting machine according to claim 2, wherein the carriage surface has a V-shaped configuration with first and second legs, and wherein each of the fastening points is disposed beneath one of the legs of the carriage surface.

4. The cutting machine according to claim 1, wherein the blade cover includes a handle disposed beneath the carriage surface.

5. The cutting machine according to claim 1, wherein the blade cover includes a cover area and a holding area such that, at least in an end position of the carriage, the cover area is disposed above the carriage surface and the holding area is disposed beneath the carriage surface.

6. The cutting machine according to claim 5, wherein the cover area is integrally connected to the holding area.

7. The cutting machine according to claim 6, wherein the cover area of the blade cover includes a positive curvature that is complementary to a negative curvature of the circular blade so that the cover area engages into a structural space formed by the negative curvature of the circular blade.

8. The cutting machine according to claim 5, wherein the cover area of the blade cover includes a positive curvature that is complementary to a negative curvature of the circular blade so that the cover area engages into a structural space formed by the negative curvature of the circular blade.

9. The cutting machine according to claim 1, wherein the blade cover includes a cover area and a holding area, a diameter of the blade cover in the cover area is smaller than a diameter of the circular blade, and a diameter of the blade cover in the holding area is greater than the diameter of the circular blade.

10. The cutting machine according to claim 1, wherein the blade cover further comprises a first gap that is configured to fit at least partially around the first fastening point.

11. The cutting machine according to claim 10, wherein the blade cover further comprises a second gap that is configured to rest on a third fastening point.

12. The cutting machine according to claim 11, wherein the third fastening point is configured as a holding pin.

13. The cutting machine according to claim 1, wherein the movable bar has a slanted ramp configured to pull against the blade protection ring.

14. A cutting machine for cutting a food product, comprising:

a housing;

a blade cover detachably mounted to the housing via at least a first fastening point and a second fastening point;

a circular blade rotatably disposed in the housing such that the blade cover covers a surface of the circular blade, wherein the housing includes a blade protection ring that encloses a cutting edge of the circular blade in a C-shaped manner, the blade cover being connected to the blade protection ring; and a carriage movably mounted parallel to the circular blade, the carriage including a carriage surface for holding the food product, wherein the first fastening point is shaped like a mushroom, wherein the second fastening point comprises a bolt disposed on the blade cover that engages into an opening of the blade protection ring, wherein the cutting machine further comprises a movable bar that, in a closed position, is configured to interact with the second fastening point to affix the blade cover by pulling the blade cover against the blade protection ring, in the closed position the movable bar being arranged behind the blade protection ring in an area of the second fastening point such that an axis of the bolt of the second fastening point is within a radius defined by a length of the movable bar from an axis of the movable bar about which the movable bar is pivotable between the closed position and an open position, and wherein the first and second fastening points detachably mounting the blade cover to the housing are disposed beneath the carriage surface.

15. The cutting machine according to claim 14, wherein the movable bar has a slanted ramp configured to pull against the blade protection ring.

* * * * *